US006216405B1

(12) United States Patent
Smith

(10) Patent No.: US 6,216,405 B1
(45) Date of Patent: Apr. 17, 2001

(54) MOUNTING AND DRAINING SYSTEM FOR PREFABRICATED BUILDING PANELS

(75) Inventor: Rodney I. Smith, Midland, VA (US)

(73) Assignee: Easi-Set Industries, Inc., Midland, VA (US)

( * ) Notice: Subject to any disclaimer, the term of this patent is extended or adjusted under 35 U.S.C. 154(b) by 0 days.

(21) Appl. No.: 09/311,579

(22) Filed: May 14, 1999

(51) Int. Cl.[7] ..... E04B 2/90

(52) U.S. Cl. ..... 52/235; 52/302.1; 52/475.1; 52/511; 52/745.13; 52/747.12

(58) Field of Search ..... 52/235, 302.1, 52/475.1, 510, 511, 747.12, 745.13

(56) References Cited

U.S. PATENT DOCUMENTS

| | | | | |
|---|---|---|---|---|
| 4,506,482 | * | 3/1985 | Pracht et al. | 52/235 |
| 5,216,858 | * | 6/1993 | Gilmour | 52/235 |
| 5,699,644 | | 12/1997 | Smith . | |
| 5,934,033 | * | 8/1999 | Matsuyama et al. | 52/235 |

* cited by examiner

*Primary Examiner*—Christopher T. Kent
(74) *Attorney, Agent, or Firm*—McGuireWoods LLP

(57) ABSTRACT

A mounting and drainage system of a prefabricated building panel. The mounting system includes a first mounting plate mounted to a vertical stud of a frame and a second mounting plate mounted to an adjacent vertical stud of the frame. The first and second mounting plates face one another. A landing pad extends between the first and second mounting plates and is mounted on a landing hook that extends outward from a floor of a building. The landing pad is retained on the landing hook by a retaining plate extending from the landing hook. Welding plates having a slot therein are also provided on other mounting plates and are welded to an edge of the floor. The landing pad is removable once the prefabricated building panel is mounted on the building.

A drainage system is also provided. The drainage system includes a drain aperture positioned on a lower track between an inner wall of building and the wall of the prefabricated building panel. A drain tube is connected to a bottom portion of the drain aperture and extends through an aperture of one of the studs, the drain tube leading to the outside.

20 Claims, 5 Drawing Sheets

MOUNTING AND DRAINING SYSTEM FOR PREFABRICATED BUILDING PANELS

BACKGROUND OF THE INVENTION

1. Field of the Invention

The present invention generally relates to a mounting and drainage system for prefabricated building panels and, more particularly, to a system for mounting prefabricated building panels onto a building structure and a system for collecting and draining water such as condensation from between the prefabricated building panels and the building.

2. Background Description

Prefabricated building panels are widely used in the construction of buildings, both small and large. These prefabricated building panels are commonly constructed from a number of materials and most preferably concrete. However, when using concrete to fabricate these panels, it is customary to use reinforced concrete in order to provide rigidity and strength to the concrete panels. It is common practice to use wire mesh for the reinforcement of the concrete panels, and to mount the concrete panels to a framing system which includes vertically aligned studs and upper and lower horizontal tracks connected to the vertically aligned studs.

The prefabricated building panels are mounted to a building structure by bolts or welding. However, in order to mount the prefabricated building panels onto a building structure, a crane must first position the panel in its proper location with relation to the building structure, itself The crane must then hold the prefabricated building panel in place while the panels are bolted or welded to the building structure. Typically, the bolting of the prefabricated building panels to the building occurs at a stud of the frame of the prefabricated building panel and the flooring system of the building structure. On the other hand, when welding is used the welding must be performed from both above and below a weld plate attached to the stud. This further delays the mounting of the panel to the building since a welder must perform the weld, including moving all of the welding equipment, from an upper floor to a lower floor level or using two welders and operators.

The bolting or welding procedure is one of the most difficult and time consuming tasks of mounting the prefabricated building panel to the building structure. This is because the prefabricated building panel must be first manually aligned onto the building structure while the prefabricated building panel is on the crane. Once properly aligned, the prefabricated building panel must then be bolted at various places on the studs to the building structure, while maintaining the proper alignment between the prefabricated building panels and building structure. In the case of welding, the welding must be performed on both an upper and lower level (as discussed above). Accordingly, the crane must be used to hold the prefabricated building panel until it is properly bolted or welded to the building structure, and thus cannot be used for other purposes. As can be imagined, this system for mounting the prefabricated building panels to the building structure is thus both time consuming and labor intensive, and an inefficient use of heavy machinery (e.g., crane) at the building site.

Once the panels are properly mounted, water such as condensation may begin to accumulate between the back surface of the panels and the building structure itself. This is a recently discovered phenomenon, and one which has only been recognized since the water accumulation is otherwise unseen during inspection or during construction of the building. This condensation may damage insulation and drywall on the interior of the building. This will also happen when the caulking between the adjacent panels begins to fail. It is also known that some materials, due to their porosity, may also permit condensation to occur. It is not uncommon for the condensation to penetrate the insulation and damage the interior of the building.

Accordingly, what is needed is an efficient temporary mounting system for mounting prefabricated building panels to buildings. What is further needed is a drainage system in order to prevent the accumulation of condensation between the interior building structure and the prefabricated building panels.

SUMMARY OF THE INVENTION

It is therefore an object of the present invention to provide a temporary and a permanent mounting system for mounting a prefabricated building panel to a building.

It is a further object of the present invention to provide a drainage system for use with prefabricated building panels so that water accumulation does not occur between the building structure and the prefabricated building panels.

It is still a further object of the present invention to provide a mounting system that provides for greater structural integrity between the connection of the prefabricated building panels and the building structure.

The present invention provides a temporary mounting and an efficient drainage system for a prefabricated building panel. The prefabricated building panel includes a frame having a plurality of vertical studs and horizontal tracks extending between upper and lower ends of the vertical studs. A section of the prefabricated building panel is mounted to an outer surface of the building frame. The mounting system includes a first mounting plate mounted to one of the vertical studs and a second mounting plate mounted to an adjacent vertical stud. The first and second mounting plates face one another. A landing pad or angle extends between the first and second mounting plates and, in preferred embodiments, is bolted to the facing mounting plates so that it may be removed after the prefabricated building panel is mounted to a building.

In the embodiments of the present invention, additional mounting plates and landing pads may be provided. The additional mounting plates may span between selected additional facing mounting plates and are bolted to the selected additional facing mounting plates. Permanent welding plates each having a slot extending substantially through the center are also provided. These slotted plates may be welded or otherwise mounted to the remaining mounting plates (as well as the selected mounting plates). The welding plates include an outward extending portion opposing the wall of the prefabricated building panel and extend past the studs.

A landing hook which extends outward from the floor of the building may also be provided. The landing pad mounts to the landing hook, and may be retained by a retaining plate extending from the landing hook. In the further embodiments of the present invention, a bracket is mounted to the floor of the building and an adjustment rod is welded to the landing hook and the bracket. The adjustment rod allows for adjustment of the prefabricated building panel once the landing pad is mounted on the landing hook.

The drainage system includes a drain aperture positioned on a lower track between an inner wall of the building and the wall of the prefabricated building panel. A drain tube is connected to a bottom portion of the drain aperture and extends through an aperture of one of the studs, leading to the outside. The drain aperture may be positioned in a trough formed by the lower track. A gutter is formed by caulking the track to the rear surface of the wall and directs condensation from an inner surface of the wall of the prefabricated building panel to the drain aperture. A slot drain may be positioned above the gutter and extends past an edge of the wall of the prefabricated building panel. A caulk seal surrounds an end of the drain tube.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

For illustrative purposes only a concrete prefabricated building panel mounted to a galvanized steel frame is described herein. However, it is well understood that other prefabricated building panels may be equally used with the present invention. It is further understood that the dimensions of the prefabricated building panels and the frame, including length, width, shape, weight and other variables and quantities specified herein may vary with the type of system contemplated. Therefore, numbers and dimensions specified herein are not to be construed as limitations on the scope of the present invention, but are meant to be merely illustrative of one particular application of the present invention.

The Mounting System

Figure 1:
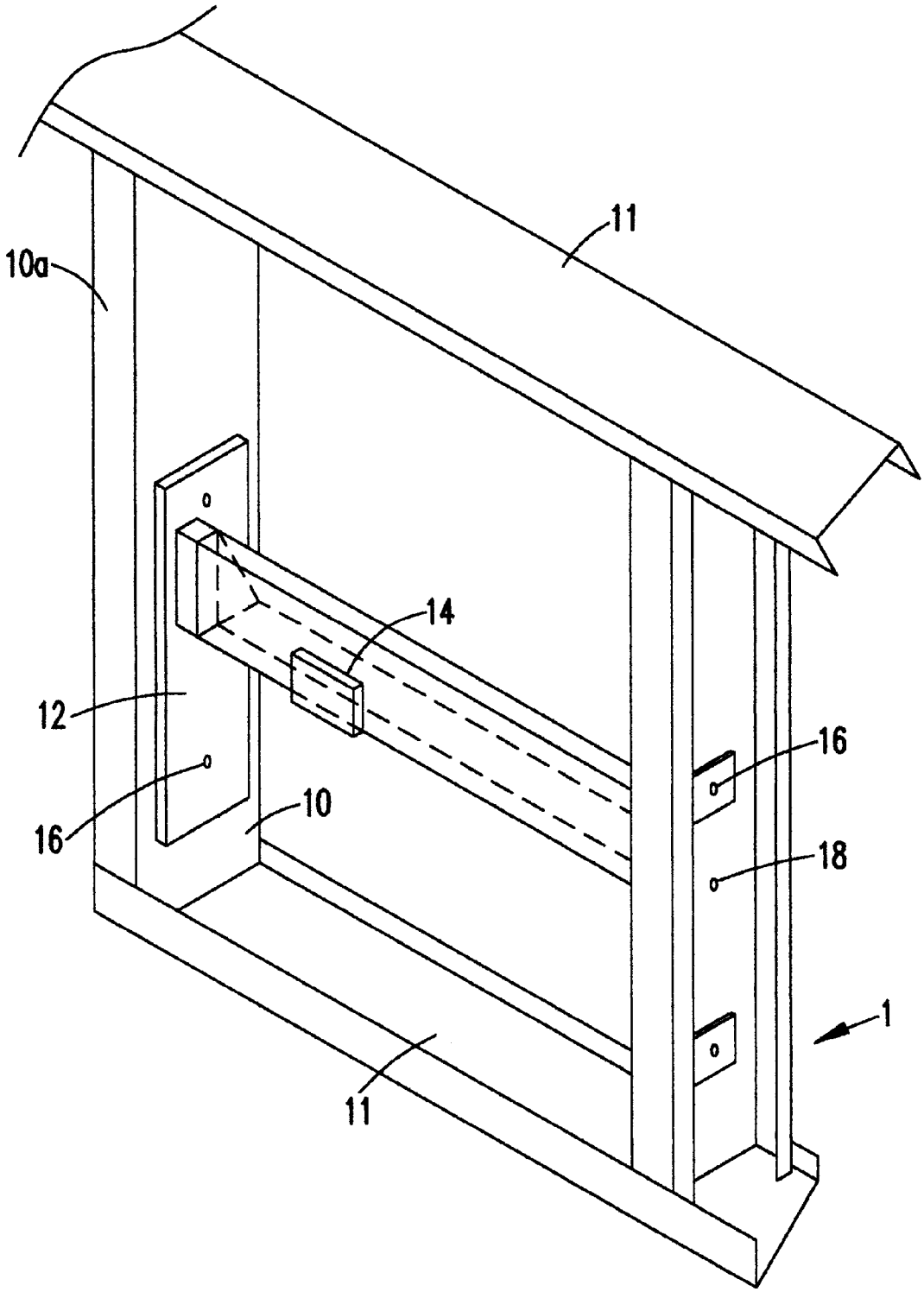
FIG. 1 shows a mounting system for temporarily mounting a frame of a prefabricated building panel to a building.

Referring now to the drawings, and more particularly to FIG. 1, there is shown a mounting system for mounting a frame of a prefabricated building panel to a building. Specifically, the frame 1 of the present invention includes vertically aligned studs 10 and horizontally aligned tracks 11 connected to the studs 10. In preferred embodiments, the studs 10 are spaced at a distance of approximately two feet. Although not shown, it is obvious to one of ordinary skill in the art that several studs 10 may be aligned within the horizontally aligned tracks 11, and that any number of spacing patterns (e.g., distances between the studs 10) may be used between the studs 10.

Referring still to FIG. 1, mounting plates 12 are facing one another and are mounted between the studs 10. In preferred embodiments, the mounting plates 12 are mounted to the studs 11 with bolts 16. Spanning between the mounting plate 12 is a landing pad or angle 14 (hereinafter a landing pad), preferably mounted to the mounting plates 12 with bolts 18. The landing pad 14 may have a triangular, square, polygonal or other cross section, and may be mounted to the mounting plates 12 using various mounting systems, such as screws or bolts.

It is preferred that the landing pad 14 be mounted to the mounting plates 12 with a mounting system that allows the landing pad 14 to be dismounted once the prefabricated building panel is properly mounted to the building structure. Also, in the embodiments of the present invention, the studs 10 and tracks 11 are galvanized heavy gauge steel, and the mounting plates 12 and the landing hooks 14 are A36 grade steel. However, it is important to note that other materials used for the frame 1 and other components can be used depending on the particular application being used with the prefabricated building panel of the present invention.

Figure 2:
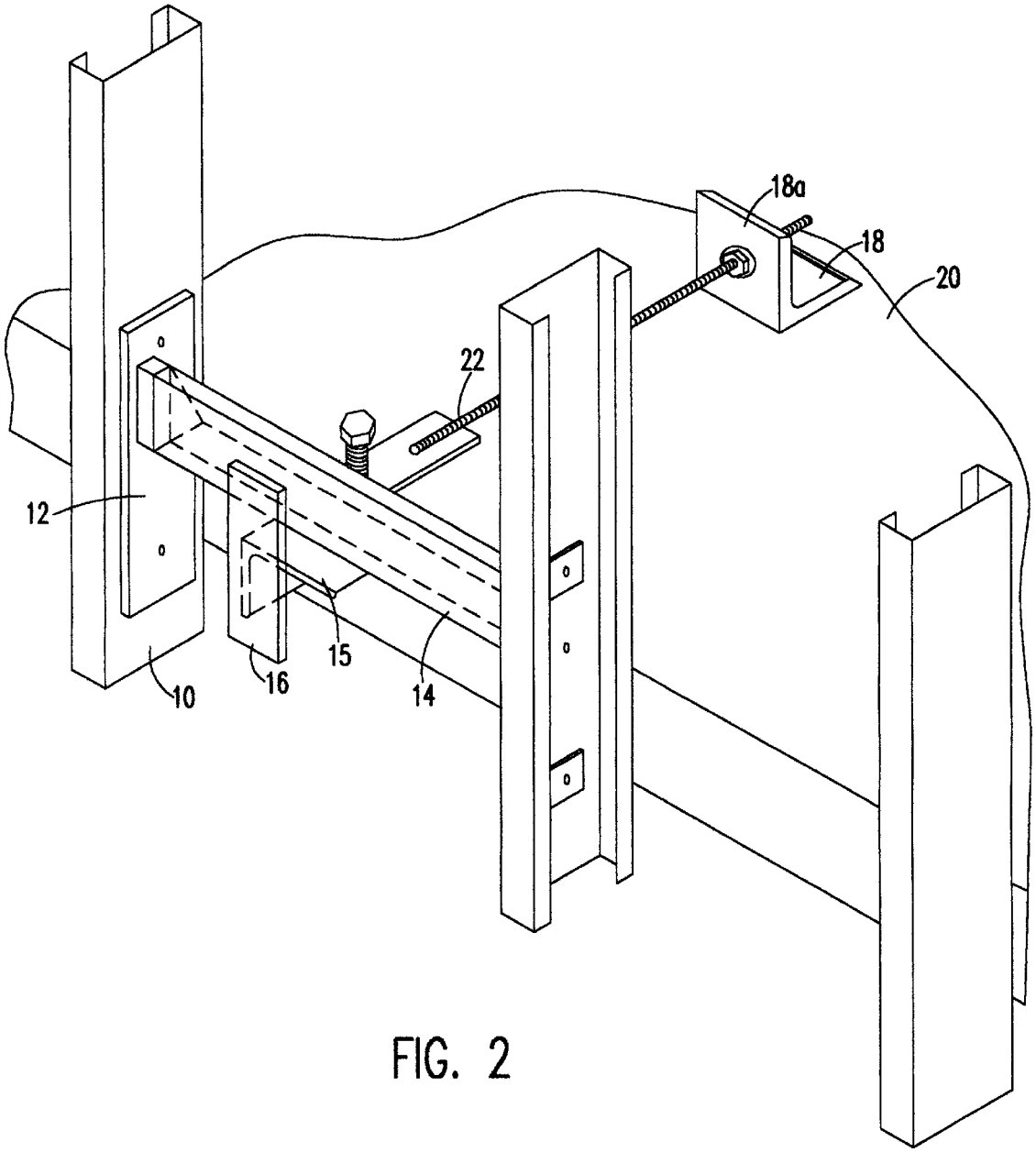
FIG. 2 shows the mounting system of the present system mounted to a floor of the building.

FIG. 2 shows the landing pad 14 mounted to a floor 20 of a building. In preferred embodiments, a landing hook 15 extends outward from the floor 20 such that the landing pad 14 can be mounted thereon. A retaining plate 16 extends from the landing hook 15 and retains the landing pad 14 on the landing hook 15 until the prefabricated building panel can be mounted onto the floor 20 of the building. It is important to note that the landing hook 15 may be placed at other locations on the building structure such as a vertically aligned beam or other structure, while still maintaining its purpose of holding the prefabricated building panel to the building while the prefabricated building panel is being mounted thereto.

Since the landing pad 14 is retained on the landing hook 15, a crane does not have to hold the prefabricated building panel in alignment with the floor 20 while it is being mounted thereto. Thus, the crane can now be utilized for other purposes, such as lifting and mounting another prefabricated building panel to the building structure.

Referring still to FIG. 2, in the embodiments of the present invention, a bracket 18 having a slot 18*a* can be mounted to the floor of the building. Attached between the landing hook 15 and the bracket 18 is an adjustment rod 22. The adjustment rod 22 can adjust the positioning and/or alignment of the prefabricated building panel prior to final mounting to the building structure. Accordingly, the adjustment rod 22 helps to facilitate the alignment and mounting of the prefabricated building panel to the building structure.

Figure 3:
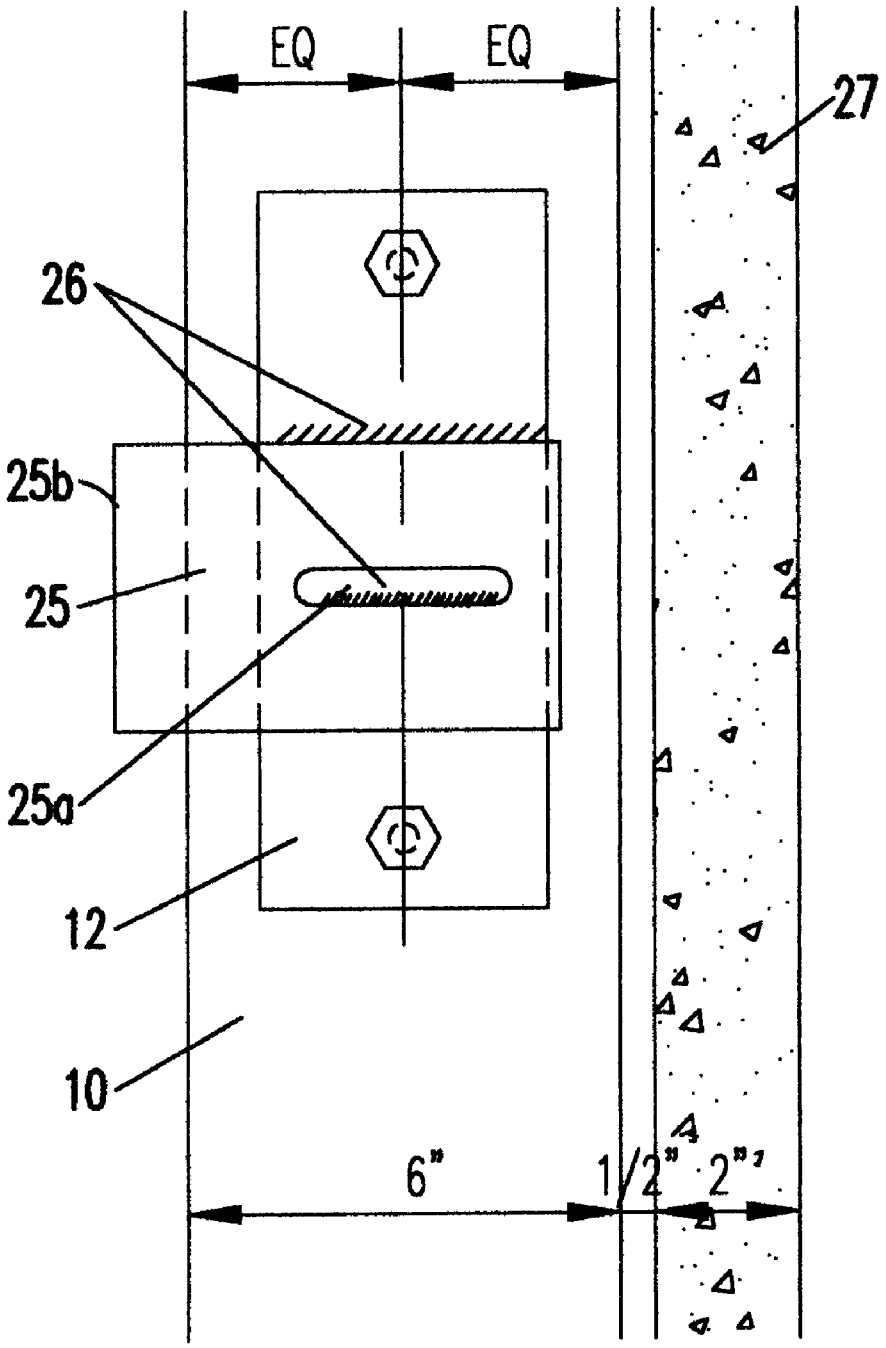
FIG. 3 shows a welding plate for permanent mounting the prefabricated building panel to the building.

FIG. 3 shows a weld plate 25 mounted to the mounting plate 12. In the preferred embodiment, the weld plate 25 includes a slot 25*a* and is welded to the mounting plate 12 at weld areas 26. The slot 25*a* allows the weld to be located in a center portion of the weld plate 25 and provides structural integrity as discussed in detail with reference to FIG. 4. As seen in FIG. 3, the weld plate 25 extends past an edge of the stud 12 opposing a floor slab 27 at extended portion 25*b*. Depending on the particular application, the weld plate 12 may be welded or otherwise mounted (e.g., bolted) to the mounting plate prior to, simultaneously with or after the landing pad 14 is placed on the landing hook 15. Also, in the embodiments, the weld plate 25 may be located above or below the landing pad 14, or may be mounted to mounting plates 12 that do not have the landing pad 14 mounted thereto. Also, the weld plate 25 may be equally used without the benefit of the landing pad 14. In the latter instance, the prefabricated building panel must be positioned and held in place by the crane prior to being mounted to the building structure.

Figure 4:
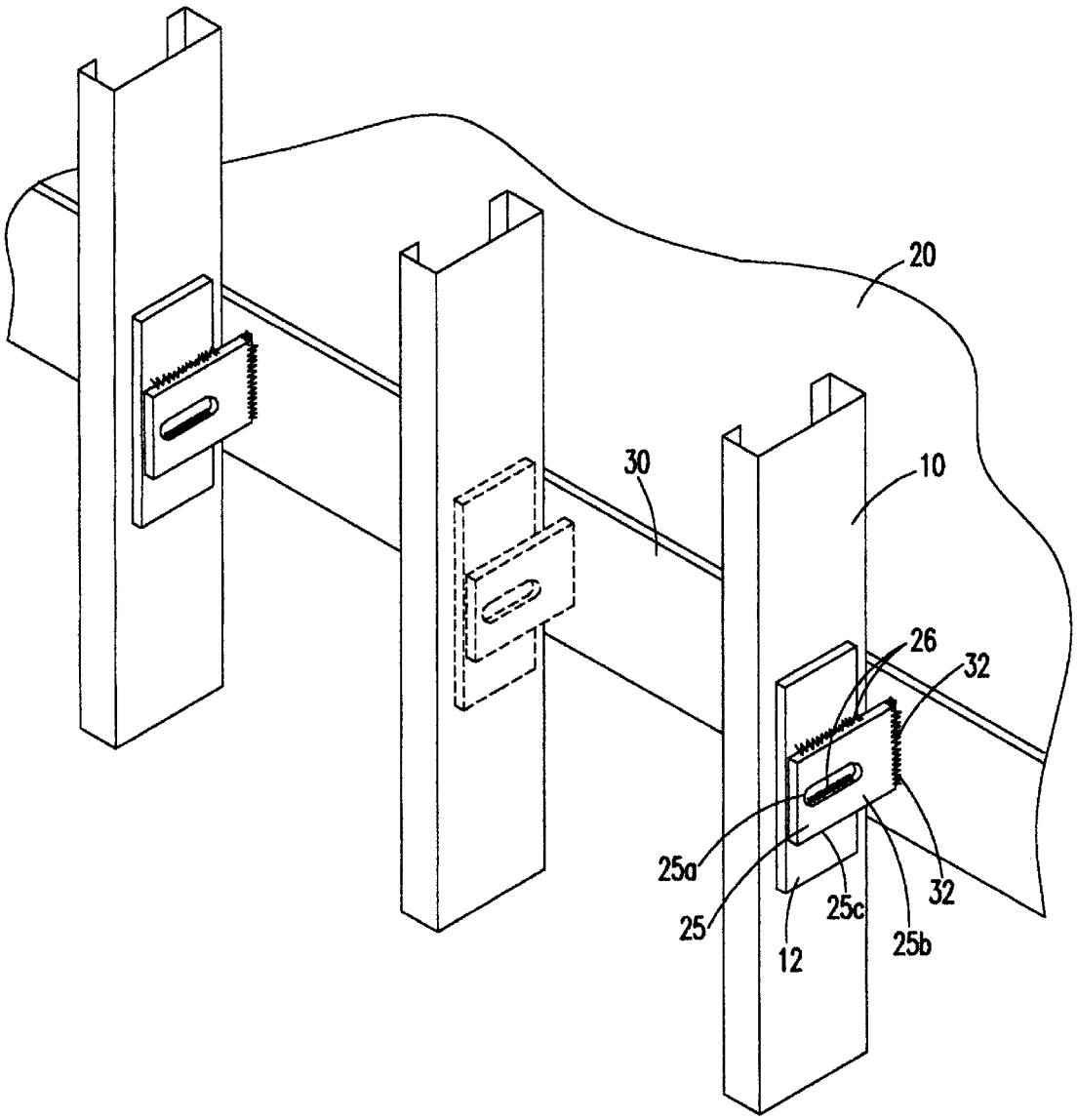
FIG. 4 shows the welding plate welded to the building.

FIG. 4 shows the weld plate 25 welded to the floor 20. Specifically, once the prefabricated building panel is properly positioned, the extended portion 25*b* of the weld plate 25 is welded to an edge angle 30 on an edge of the floor 20. The weld plate 25 is welded at welding location 32. At this time, the weld plate 25 may also be welded to the mounting plate 12 at locations 26 (FIG. 3). The weld areas of the slot 25*a* of each weld plate 25 provides for more surface area for the welds thus providing a better and more robust weld area, and further permits welding to be performed from one location. The weld plates 25 may be located on every stud 10 or spaced on every other stud 10 or other spacing patterns depending on the size and weight of the prefabricated building panel and other engineering criteria.

By using this system, the frame 1 can be mounted to the floor 20 from one location (e.g., on top of the floor), and does not have to be welded at a bottom edge 25*c* of the weld plate 25. Thus, a welder does not have to weld the weld plate 25 from above and below the weld plate 25 in order to properly mounted the prefabricated building panel to the building structure. Now, the welder needs only to weld the weld plate 25 to the building structure and the studs 10 of the prefabricated building panel from the floor 20 of the building structure at locations 26 and 32.

The Drainage System

Figure 5:
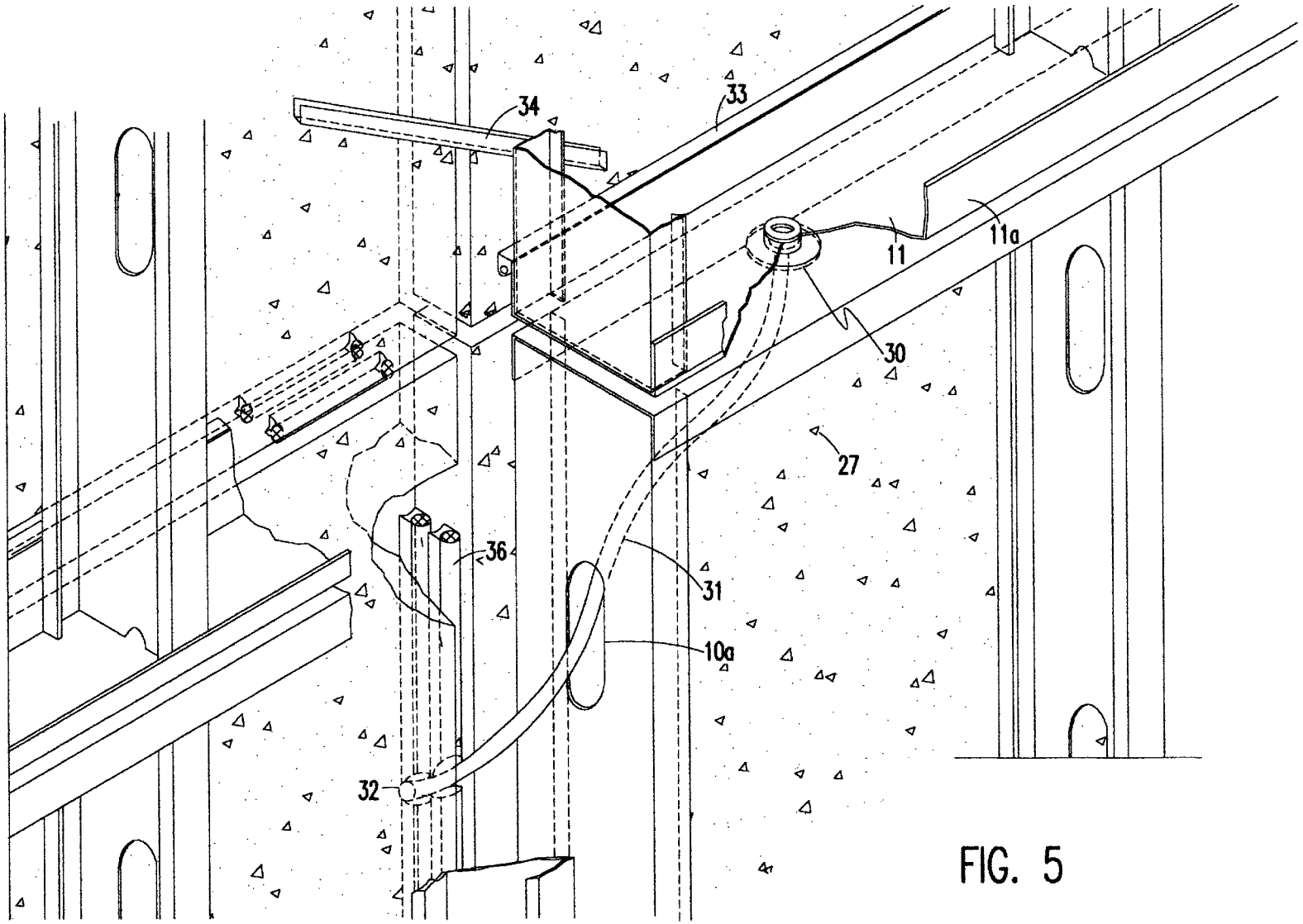
FIG. 5 shows a drainage system of the present invention.

FIG. 5 shows the drainage system of the present invention. It is well known to one of ordinary skill in the art that the mounting system and the drainage system may or may not be used together in the prefabricated building panel. Specifically, opposing sidewalls 11*a* of the lower track 11 form a gutter, and a drain aperture 30 is positioned within the gutter. The drain system further includes a drain tube 31 connected to the bottom of the drain aperture 30 and extends through an aperture 10*a* on the stud 10. In further embodiments, the drain tube 31 further extends through a caulking 36 placed between adjacent prefabricated building panels. Surrounding the drain tube 31 at the caulking 36 is preferably a caulk seal 32. In the preferred embodiment, the drain tube 31 is a PVC drain tube having approximately one half inch diameter and extending to an outer portion of the building.

Caulking 33 extends the entire length of a sidewall 11*a* of the lower track 11 and, in preferred embodiments, bridges the space between the sidewall 11*a* of the lower track 11 and the prefabricated slab. A slot drain 34 is positioned above the caulking 33 and extends onto an adjacent prefabricated slab 27. Water which may leak through caulking 36 is guided to the gutter by the slot drain 34 and then into the drain aperture 30 through the drain tube 31 and to the outside. Similarly, any condensation that may form on the inner surface of the prefabricated slab 27 will drain to the gutter and then into the drain aperture 30 through the drain tube 31 and to the outside. Thus, water will not accumulate within the gutter of the frame.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A mounting system of a prefabricated building panel, the prefabricated building panel includes a frame having a plurality of vertical studs and horizontal tracks extending between upper and lower ends of the vertical studs, a section of the prefabricated building panel is mounted to an outer surface of the building floor, the mounting system comprising:

a first mounting plate mounted to one of the vertical studs;

a second mounting plate mounted to an adjacent vertical stud, the first and second mounting plates facing one another; and a landing pad extending between the first and second mounting plate.

2. The mounting system of claim 1, wherein the first and second mounting plates are bolted to the vertical studs.

3. The mounting system of claim 1, further comprising additional mounting plates, the additional mounting plates being mounted to additional studs of the plurality of studs.

4. The mounting system of claim 3, wherein the additional mounting plates are mounted to adjacent studs of the additional studs.

5. The mounting system of claim 4, further comprising additional landing pads spanning between selected additional facing mounting plates and are bolted to the selected additional facing mounting plates.

6. The mounting system of claim 1, wherein the landing pad is bolted to the first and second mounting plates such that the landing pad is detachable from the first and second mounting plates prior to the prefabricated building panel being permanently mounted a building.

7. The mounting system of claim 1, wherein the mounting plates and landing pad are steel and the studs are galvanized steel or stainless steel.

8. The mounting system of claim 1, further comprising welding plates, the welding plates each having a slot extending substantially through the center thereof, the welding plates are welded to the mounting plates at a top edge and locations within the slot of the weld plate.

9. The mounting system of claim 8, wherein the welding plates include an extension extending past the studs on an opposite side of the section of the prefabricated building panel.

10. The mounting system of claim 1, further comprising:

additional mounting plates, the additional mounting plates being mounted to additional studs of the plurality of studs; and welding plates, the welding plates each having a slot extending substantially through the center thereof and being mounted to selected additional mounting plates.

11. The mounting system of claim 1, wherein the landing pad has a triangular, square or polygonal cross section.

12. A mounting system for mounting a prefabricated building panel to a floor of a building, the prefabricated building panel includes a frame having a plurality of vertical studs and horizontal tracks extending between upper and lower ends of the vertical studs, a wall of the prefabricated building panel is mounted to an outer surface of the frame, the mounting system including:

a first mounting plate mounted to one of the vertical studs;

a second mounting plate mounted to an adjacent vertical stud, the first and second mounting plates facing one another;

a temporary landing pad extending between the first and second mounting plates; and a landing hook extending outward from the floor, the temporary landing pad being mounted on the landing hook.

13. The mounting system of claim 12, further comprising a retaining plate extending from the landing hook and retaining the landing hook on the landing pad.

14. The mounting system of claim 12, further comprising:

a bracket mounted to the floor of the building; and an adjustment rod connecting the landing hook to the bracket.

15. The mounting system of claim 12, further comprising:

additional mounting plates, the additional mounting plates being mounted to additional studs of the plurality of studs; and welding plates, the welding plates each having a slot extending substantially through the center thereof and being mounted to selected additional mounting plates.

16. A drainage system for a prefabricated building panel, the prefabricated building panel includes a frame having a plurality of vertical studs and horizontal tracks extending between upper and lower ends of the vertical studs, a wall of the prefabricated building panel is mounted to an outer surface of the frame, the mounting system including:

a drain aperture positioned on a lower track of the horizontal tracks; and a drain tube connected to a bottom portion of the drain aperture and extending through an aperture of one of the studs, the drain tube leading to the outside.

17. The drainage system of claim 16, wherein the lower track includes opposing sidewalls forming a trench, the drain aperture being positioned within the trench.

18. The drainage system of claim 16, further comprising a guide extending substantially about an entire length of a sidewall of the lower track for directing condensation from an inner surface of the wall of the prefabricated building panel to the drain aperture.

19. The drainage system of claim 16, further comprising a slot drain positioned above a gutter and extending past an edge of the wall of the prefabricated building panel.

20. A mounting and drainage system of a prefabricated building panel, the prefabricated building panel includes a frame having a plurality of vertical studs and horizontal tracks extending between upper and lower ends of the vertical studs, a wall of the prefabricated building panel is mounted to an outer surface of the frame, the mounting system comprising:

a first mounting plate mounted to one of the vertical studs;

a second mounting plate mounted to an adjacent vertical stud, the first and second mounting plates facing one another;

a landing pad extending between the first and second mounting plates;

a drain aperture positioned on a lower track of the horizontal tracks between an outer surface of an inner wall of a building and the inner surface of the wall of the prefabricated building panel; and a drain tube connected to a bottom portion of the drain aperture and extending through an aperture of one of the studs, the drain tube leading to the outside by a drain tube extending therefrom.

* * * * *